US005621995A

United States Patent [19]

Smith

[11] Patent Number: 5,621,995

[45] Date of Patent: Apr. 22, 1997

[54] GUN DOUBLE COLUMN STAGGERED ROUND HIGH CAPACITY MAGAZINE ENTRANCE GUIDE

[76] Inventor: Alan K. Smith, 113 La Fawn Cir., Garland, Tex. 75043

[21] Appl. No.: 172,484

[22] Filed: Dec. 22, 1993

[51] Int. Cl.[6] ..... F41A 9/65

[52] U.S. Cl. ..... 42/7; 42/50; 89/33.1

[58] Field of Search ..... 42/49.01, 50, 7; 89/33.1, 34

[56] References Cited

U.S. PATENT DOCUMENTS

| | | | |
|---|---|---|---|
| 4,520,585 | 6/1985 | Barrett | 42/7 |
| 4,570,370 | 2/1986 | Smith et al. | 42/90 |
| 5,052,140 | 10/1991 | Smith | 42/7 |
| 5,293,708 | 3/1994 | Strayer et al. | 42/7 |

*Primary Examiner*—Stephen M. Johnson
*Attorney, Agent, or Firm*—Ronnie D. Wilson

[57] ABSTRACT

A magazine entrance guide integral with the mainspring housing of the firearm is provided. It is a guide having four sloped surfaces front, back and two opposite sides guiding double column staggered round high capacity magazine entrance during insertions. The magazine entrance guide with widely spaced sides in one embodiment has upwardly extended opposite side stabilizing extensions enclosing opposite sides of the gun butt within opposite side grip plates that counter torsion forces between the guide and the mainspring housing. In another embodiment opposite side stabilizing extensions are positioned within the angled out opening sides of the gun butt magazine opening to counter torsion forces between the guide and the mainspring housing.

20 Claims, 2 Drawing Sheets

GUN DOUBLE COLUMN STAGGERED ROUND HIGH CAPACITY MAGAZINE ENTRANCE GUIDE

Figure 1:
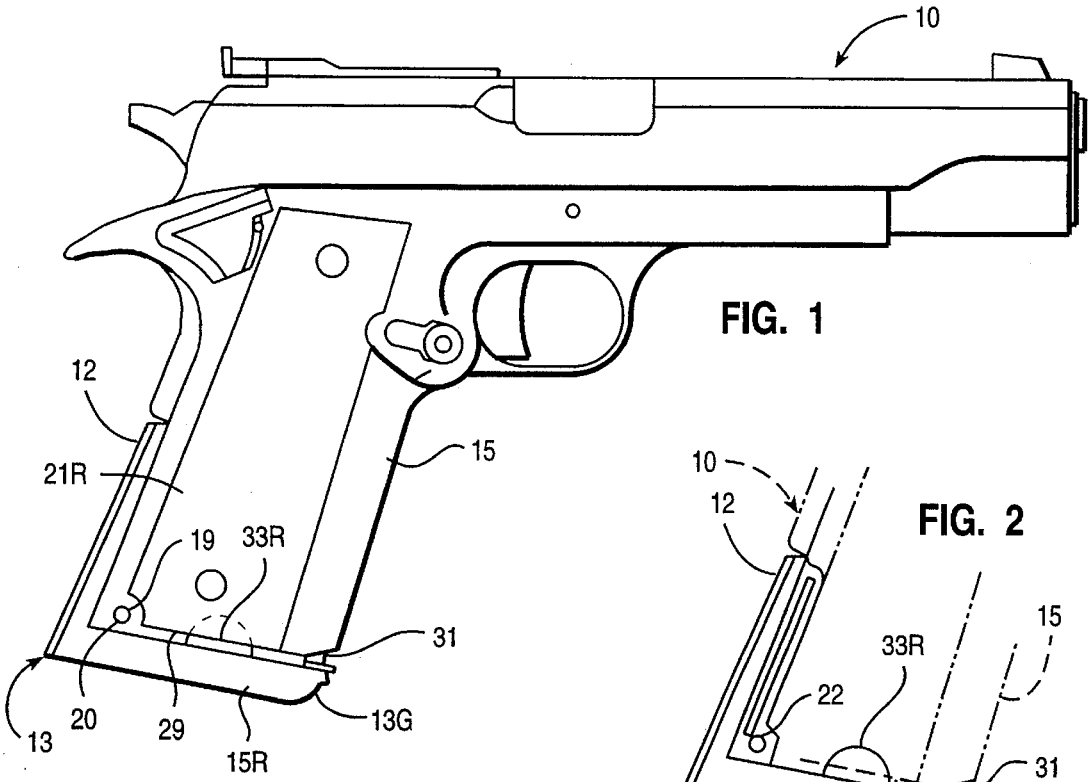

This invention relates in general to gun magazine entrance and grip structures, and more particularly, to an enlarged wide angled magazine guide with four sloped surfaced front, back and two opposite sides and with upwardly extended opposite side stabilizing extensions countering torsion forces otherwise imposed on the guide.

Magazine insertion in the receiver of pistol butts is many times more difficult and slower than desired particularly under a stress situation such as in target shooting matches, law enforcement or military use. Further, through periods of rapid shooting with repeated insertion of fresh magazine clips it is important that the hand grip of the gun be stabilized for enhanced accuracy of shooting repeated rounds. These factors are enhanced if the gun grip is both lengthened and flanged out below the butt bottom and the magazine receiver is provided with a wide angled guide mouth opening for guiding fresh magazines into the gun receiver without catch, hang up or binding. With a double column staggered round high capacity wide opening magazine entrance guide torsion forcer can be imposed on the guide and from the guide to the mainspring housing.

It is therefore a principal object of this invention to provide an improved magazine insertion guide for extra wide double column high capacity gun magazines.

Another object is to provide such an improved magazine insertion guide that beneficially, via lengthening of the gun grip, enhances stability in holding of the gun.

A further object is to improve ease and speed of fresh magazine insertion in a gun receiver.

Still another object is to eliminate gun magazine insertion catch, hang up or insert binding as magazines are being changed in a gun.

Another object is to counter torsion forces that are from time to time imposed on gun magazine guides and from the guides to mainspring housings guides are connected to.

Features of the invention useful in accomplishing the above objects include a gun double column staggered round high capacity magazine entrance guide integral with the mainspring housing of the firearm. It is a guide having four sloped surfaces front, back and two opposite sides guiding double column staggered round high capacity magazine entrance during insertions. The magazine entrance guide with widely spaced sides in one embodiment has upwardly extended opposite side stabilizing extensions enclosing opposite sides of the gun butt within opposite side grip plates that counter torsion forces between the guide and the mainspring housing. In another embodiment opposite side stabilizing extensions are positioned within the angled out opening sides of the gun butt magazine opening to counter torsion forces between the guide and the mainspring housing.

Specific embodiments representing what are presently regarded as the best modes of carrying out the invention are illustrated in the accompanying drawings.

Figure 2:
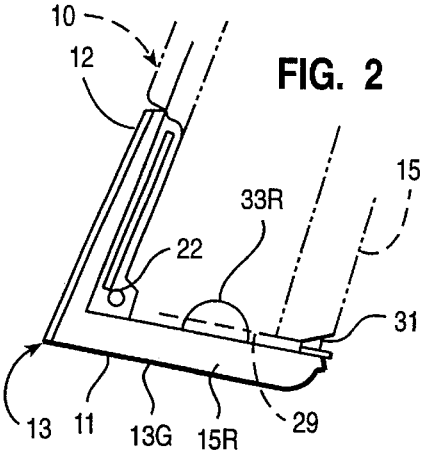
Figure 3:
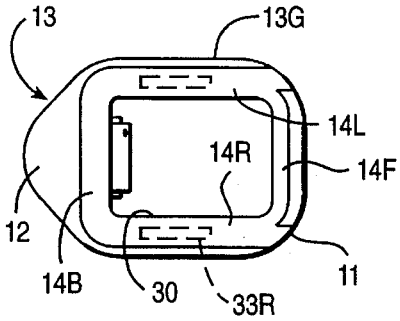
Figure 4:
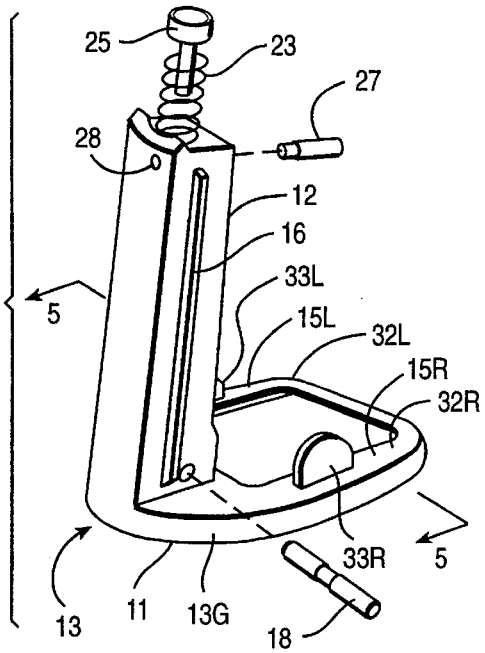
Figure 5:
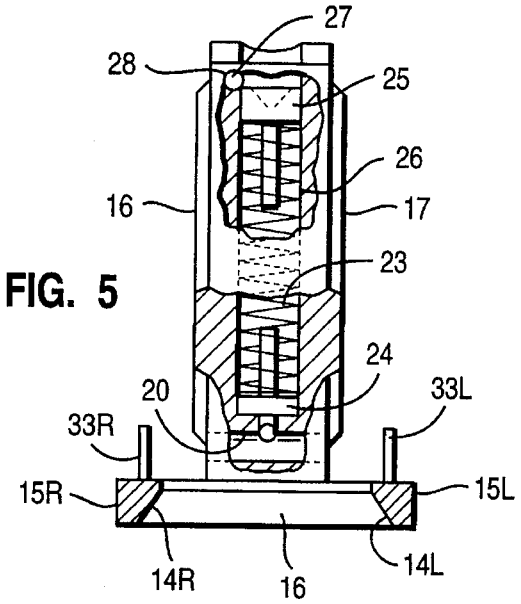
Figure 6:
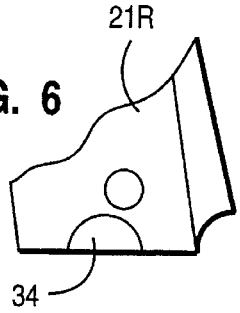
Figure 7:
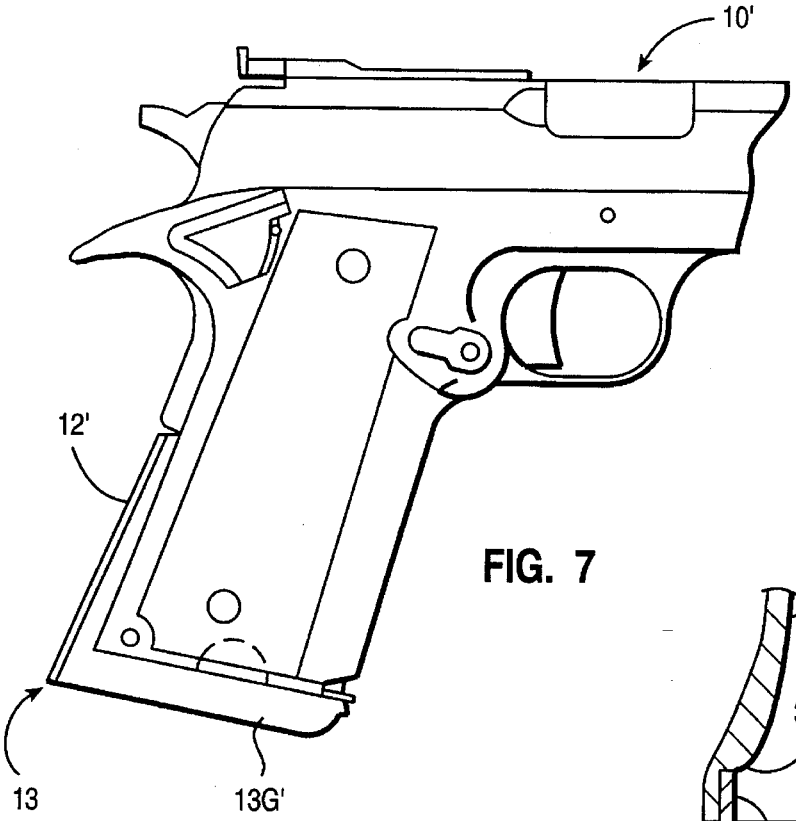
Figure 8:
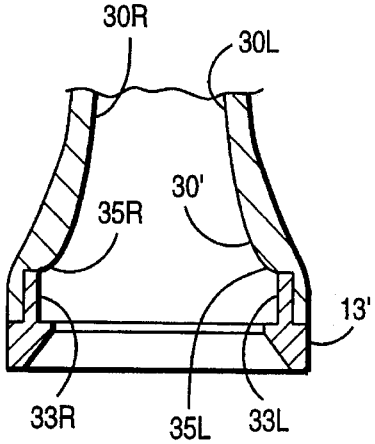

In the drawings:

FIG. 1 represents the right hand side elevation view of a semi automatic pistol with a magazine entrance guide opening extension equipped pistol mainspring housing;

FIG. 2, a right hand side elevation view of a unitary mainspring housing with a magazine entrance guide opening extension;

FIG. 3, a bottom plan view of the unitary mainspring housing and magazine entrance opening guide extension;

FIG. 4, a perspective view of the unitary mainspring housing and the magazine entrance opening guide extension with opposite side top stabilizing extensions;

FIG. 5, a partially cut away and sectioned view of the unitary housing and magazine entrance opening guide extension taken from line 5—5;

FIG. 6, a partial view showing lower inside detail of a gun butt grip side plate removed and flipped over from the showing of FIG. 1;

FIG. 7, a partial right hand side elevation view of another semi automatic pistol similar to FIG. 1, with however, a flared out bottom magazine insertion opening and magazine entrance guide opening extensions equipped pistol mainspring housing embodiment; and, FIG. 8, an enlarged partial broken away and sectioned view taken from line 8—8 of FIG. 7 showing magazine entrance guide opening extension detail with opposite side top stabilizing extension tabs extended up within the gun butt flared out magazine bottom opening and tab relief openings within the magazine bottom opening.

Referring to the drawings:

The semi automatic pistol 10 of FIG. 1 is shown to be equipped with a magazine receiver entrance guide opening extension 11 from the pistol mainspring housing 12 that are joined together as a unitary structure 13 shown also in FIGS. 2–5. The opening extension 11 is in the form of a generally rectangular magazine entrance 13G guide with enlarged wide angled sloped sides front 14F, back 14B and two opposite left and right side surfaces 14L and 14R on opposite sides 15L and 15R. The unitary structure 13 is mounted on the gun butt 15 of the pistol 10 containing the magazine receiver with the mainspring housing 12 portion thereof mounted in the pistol butt 15 with opposite side flanges 16 and 17 received and held in internal retaining grooves (details not shown) in the gun butt 15 just as with a stock mainspring housing. Further, the unitary structure is held in place with the main spring housing pin 18 pressed in place through openings 19 in the gun butt and opening 20 through mainspring housing 12. Thus, the pistol, other than the pistol butt 15 opposite grip sides 21L and 21R, is in its original unaltered state, and other than unitary structure 13 with mainspring housing 12 mounted on the pistol butt 15 just as with a standard stock mainspring housing.

The mainspring housing 12 of unitary structure 13 holds a main spring 23 between pin retainer 24 at the bottom and cap 25 within housing opening 26 as restrained in place by main spring cap pin 27 extended through housing opening 28. The forward extended arms 14R and 14L of the extension 11 underlie the bottom 29 of butt 15 and have a tolerance spacing therefrom to accomodate interchangeability of the unitary structure 13 to any of the stock pistols of a particular mass produced model. Arms 15R and 15L are so spaced as to be in alignment with opposite sides of the magazine receiver opening 30. The beveled surfaces 14R and 14L of the arms 15R and 15L and the beveled surface 16 interconnecting beveled surfaces 14R and 14L are all angled toward the magazine receiver opening 30 so as to guide a magazine 31 being moved toward the opening 30 smoothly and easily into the opening for easy and fast smooth insertion of magazines 31 into the receiver opening 30 in the grip 17 of pistol 10. The opening extension 11 from the pistol mainspring housing 12 is also, in effect, an extension of the grip 17 helping to stabilize the gun in the hand through periods of rapid shooting with repeated insertion of fresh magazines 31 for enhanced accuracy of shooting repeated rounds.

The magazine receiver entrance guide opening extension 11 has widely spaced side arms 15L and 15R that have flat upper surfaces 32L and 32R with upwardly extended opposite side stabilizing extensions 33L and 33R that enclose opposite sides of the gun butt 15. The stabilizing extensions 33L and 33R also extend upward within opposite side grip plates 21L and 21R that are provided with rounded recess openings 34 that accomodate the rounded extensions 33L and 33R that counter torsion forces otherwise imposed from time to time between the guide extension 11 and the mainspring housing 12.

Please refer now to the gun 10' embodiment of FIGS. 7 and 8, a flared out bottom magazine insertion receiver opening 30' upward extended opposite side stabilizing extensions 33L and 33R are positioned. within the angled out opening 30' opposite sides 30L and 30R have inner opening rounded recesses 33L and 33R receive the extensions 33L' and 33R ' within opening 30' counter torsion forces otherwise imposed from time to time between the guide 11 and the mainspring housing 12'.

It should be noted that some semi-automatic and other pistols have a mounting projection extending upward, in place of a mainspring housing, from the magazine guide base insertable into a gun butt rear opening mounting the magazine entrance guide on the gun butt.

Whereas this invention has been described with respect primarily to two embodiments thereof, it should be realized that various changes may be made without departing from the essential contributions to the art made by the teachings hereof.

I claim:

1. An angled gun magazine entrance guide for easier and faster insertions of fresh magazines into a gun butt having a gun butt receiver opening comprising: extension means integral with a gun mainspring housing mounted on said gun butt having said gun butt receiver opening; said extension means including opposite side arms extended forwardly from said mainspring housing; said opposite side arms being formed with inner side angled opening outward slopes extended outwardly from said gun butt receiver opening to opposite sides of said gun butt receiver opening making the insertion of a fresh magazine into said gun butt receiver opening easier and faster; said opposite side arms each being formed with a flat surface abutting the surface of said gun butt receiver opening; and opposite side stabilizing extensions positioned on said flat surfaces to engage opposite sides of said gun butt receiver opening to resist torsion imposed from time to time on said extension means of said angled gun magazine entrance guide.

2. The angled gun magazine entrance guide of claim 1, wherein the magazine entrance guide includes an angle sloped back side interconnecting said side arm inner side angled opening outward slopes.

3. The angled gun magazine entrance guide of claim 2, wherein said opposite side stabilizing extensions are located adjacent to opposite outer sides of said gun butt receiver opening.

4. The angled gun magazine entrance guide of claim 3, wherein opposite side gun grip plates are mounted on the outside of said gun butt having said gun butt receiver opening; and said opposite side stabilizing extensions extend up and between said opposite side gun grip plates and said gun butt receiver opening.

5. The angled gun magazine entrance guide of claim 4, wherein recess openings are provided in said grip plates to accommodate space wise said opposite side stabilizing extensions.

6. The angled gun magazine entrance guide of claim 5, wherein said opposite side stabilizing extensions are in side profile rounded extensions.

7. The angled gun magazine entrance guide of claim 2, wherein said opposite side stabilizing extensions are positioned along the side-surfaces of said gun butt magazine receiver opening.

8. The angled gun magazine entrance guide of claim 7, wherein said side-surfaces or said gun butt magazine receiver opening are divergently angled outward at the contact points of said gun butt receiver opening and said angled gun magazine entrance guide.

9. The angled gun magazine entrance guide of claim 8, wherein said side-surfaces have recesses sized to receive portions of said opposite side stabilizing extensions.

10. The angled gun magazine entrance guide of claim 9, wherein said opposite side stabilizing extensions are in side profile rounded extensions.

11. The angled gun magazine entrance guide of claim 1, wherein said magazine entrance guide is a closed front end magazine receiver opening entrance guide with said opposite sides joined at said front end by a cross member having a sloped surface interconnecting said side arm inner side angled opening outward slopes.

12. An angled gun magazine entrance guide for easier and faster insertions of fresh magazines into a gun butt having a gun butt receiver opening comprising: extension means integral with said gun butt including upward projecting mounting extension mountable on said gun butt; said extension means including opposite side arms extended forwardly from said upward projecting mounting extension; said opposite side arms being formed with inner side angled opening outward slopes extended outwardly from said gun butt receiver opening to opposite sides of said gun butt receiver opening making the insertion of a fresh magazine into said gun butt receiver opening easier and faster; said opposite side arms each being formed with a flat surface abutting the surface of said gun butt; and opposite side stabilizing extensions positioned on said flat surfaces to engage opposite sides of said gun butt receiver opening to resist torsion imposed from time to time on said extension means and on said upward mounting extension of said angled gun magazine entrance guide.

13. The angled gun magazine entrance guide of claim 12, wherein the magazine entrance guide includes an angle sloped back side interconnecting said side arm inner side wide angled opening outward slopes.

14. The angled gun magazine entrance guide of claim 12, wherein said magazine entrance guide is a closed front end magazine receiver opening entrance guide with said opposite side arms joined at said front end by a cross member having a sloped surface interconnecting said side arm inner side angled opening outward slopes.

15. The angled gun magazine entrance guide of claim 14, wherein said opposite side stabilizing extensions are located adjacent to opposite outer sides of said gun butt magazine receiver opening.

16. The angled gun magazine entrance guide of claim 15, wherein opposite side gun grip plates are mounted on the outside of said gun butt having said gun butt receiver opening; and said opposite side stabilizing extensions extend up and between said opposite side gun grip plates and said gun butt receiver opening.

17. The angled gun magazine entrance guide of claim 16, wherein recess openings are provided in said grip plates to accommodate space wise said opposite side stabilizing extensions; and wherein said opposite side stabilizing extensions are in side profile rounded extensions.

18. The angled gun magazine entrance guide of claim 12, wherein said opposite side stabilizing extensions are positioned along the side-surfaces of said gun butt magazine receiver opening; and wherein said side-surfaces of said gun butt magazine receiver opening are divergently angled outwardly at the contact points of said gun butt receiver opening and said angled gun magazine entrance guide.

19. The angled gun magazine entrance guide of claim 18, wherein said side-surfaces have recesses sized to receive portions of said opposite side stabilizing extensions.

20. The angled gun magazine entrance guide of claim 19, wherein said opposite side stabilizing extensions are in side profile rounded extensions.

* * * * *